US007562697B2

(12) United States Patent
Gorbounov et al.

(10) Patent No.: US 7,562,697 B2
(45) Date of Patent: Jul. 21, 2009

(54) HEAT EXCHANGER WITH PERFORATED PLATE IN HEADER

(75) Inventors: Mikhail B. Gorbounov, South Windsor, CT (US); Igor B. Vaisman, West Hartford, CT (US); Parmesh Verma, Manchester, CT (US); Moshen Farzad, Glastonbury, CT (US); Mark A. Daniels, Manlius, NY (US); Joseph B. Wysocki, Somers, CT (US)

(73) Assignee: Carrier Corporation, Farmington, CT (US)

( * ) Notice: Subject to any disclaimer, the term of this patent is extended or adjusted under 35 U.S.C. 154(b) by 36 days.

(21) Appl. No.: 11/793,434

(22) PCT Filed: Dec. 28, 2005

(86) PCT No.: PCT/US2005/047365

§ 371 (c)(1),
(2), (4) Date: Jun. 18, 2007

(87) PCT Pub. No.: WO2006/083451

PCT Pub. Date: Aug. 10, 2006

(65) Prior Publication Data

US 2008/0289806 A1 Nov. 27, 2008

Related U.S. Application Data

(60) Provisional application No. 60/649,434, filed on Feb. 2, 2005.

(51) Int. Cl.
*F28F 9/22* (2006.01)

(52) U.S. Cl. ..... 165/174; 165/175

(58) Field of Classification Search ..... None
See application file for complete search history.

(56) References Cited

U.S. PATENT DOCUMENTS

| | | | | |
|---|---|---|---|---|
| 2,297,633 | A | 9/1942 | Philipp | |
| 2,591,109 | A | 4/1952 | Wade | |
| 2,707,868 | A * | 5/1955 | Goodman | 62/196.4 |
| 3,920,069 | A | 11/1975 | Mosier | |
| 4,088,182 | A | 5/1978 | Basdekas et al. | |
| 4,382,468 | A | 5/1983 | Hastwell | |
| 4,497,363 | A | 2/1985 | Heronemus | |

(Continued)

FOREIGN PATENT DOCUMENTS

| | | |
|---|---|---|
| CN | 1611907 | 5/2005 |

(Continued)

*Primary Examiner*—Allen J Flanigan
(74) *Attorney, Agent, or Firm*—Marjama Muldoon Blasiak & Sullivan LLP

(57) ABSTRACT

A heat exchanger includes an inlet header, an outlet header and a plurality of flat, multi-channel heat exchange tubes extending therebetween. A longitudinally extending member divides the interior of the header into a first chamber on one side thereof for receiving a fluid and a second chamber on the other side thereof. A plurality of multi-channel heat exchange tubes extend between the headers with the respective inlet end of each heat exchange tube passing into the second chamber of the inlet header. Fluid passes through a series of longitudinally spaced openings in the longitudinally extending member for distribution to the inlets to the channels of the multi-channel heat exchange tubes. The fluid may undergo expansion as it passes through the openings.

9 Claims, 6 Drawing Sheets

U.S. PATENT DOCUMENTS

| | | | | |
|---|---|---|---|---|
| 4,607,689 | A | 8/1986 | Mochida et al. | |
| 4,724,904 | A | 2/1988 | Fletcher et al. | |
| 5,242,016 | A * | 9/1993 | Voss et al. | 165/174 |
| 5,320,165 | A | 6/1994 | Hughes | |
| 5,341,870 | A | 8/1994 | Hughes et al. | |
| 5,415,223 | A | 5/1995 | Reavis et al. | |
| 5,479,985 | A * | 1/1996 | Yamamoto et al. | 165/126 |
| 5,517,757 | A | 5/1996 | Hayashi et al. | |
| 5,632,329 | A | 5/1997 | Fay | |
| 5,743,329 | A | 4/1998 | Damsohn et al. | |
| 5,826,649 | A | 10/1998 | Chapp et al. | |
| 5,934,367 | A | 8/1999 | Shimmura et al. | |
| 5,941,303 | A | 8/1999 | Gowan et al. | |
| 5,967,228 | A | 10/1999 | Bergman et al. | |
| 5,971,065 | A | 10/1999 | Bertilson et al. | |
| 6,340,055 | B1 | 1/2002 | Yamauchi et al. | |
| 6,546,998 | B2 | 4/2003 | Oh et al. | |
| 6,564,863 | B1 | 5/2003 | Martins | |
| 6,688,137 | B1 | 2/2004 | Gupte | |
| 6,688,138 | B2 | 2/2004 | DiFlora | |
| 6,827,139 | B2 * | 12/2004 | Kawakubo et al. | 165/173 |
| 7,011,149 | B2 * | 3/2006 | Fujita et al. | 165/173 |
| 2001/0004935 | A1 | 6/2001 | Sanada et al. | |
| 2003/0116308 | A1 | 6/2003 | Watanabe et al. | |
| 2003/0155109 | A1 | 8/2003 | Kawakubo et al. | |

FOREIGN PATENT DOCUMENTS

| | | |
|---|---|---|
| EP | 0228330 | 7/1987 |
| FR | 1258044 | 2/1961 |
| JP | 02154995 | 6/1990 |
| JP | 2217764 | 8/1990 |
| JP | 4080575 | 3/1992 |
| JP | 6241682 | 9/1994 |
| JP | 7301472 | 11/1995 |
| JP | 8233409 | 9/1996 |
| JP | 09273703 | 10/1997 |
| JP | 11351706 | 12/1999 |
| JP | 2001074388 A * | 3/2001 |
| JP | 2002022313 | 1/2002 |
| WO | WO-0242707 | 5/2002 |

* cited by examiner

HEAT EXCHANGER WITH PERFORATED PLATE IN HEADER

CROSS-REFERENCE TO RELATED APPLICATION

Reference is made to and this application claims priority from and the benefit of U.S. Provisional Application Ser. No. 60/649,434, filed Feb. 2, 2005, and entitled MINI-CHANNEL HEAT EXCHANGER WITH FLUID EXPANSION USING RESTRICTIONS IN THE FORM OF INSERTS IN THE PORTS, which application is incorporated herein in its entirety by reference.

FIELD OF THE INVENTION

This invention relates generally to refrigerant vapor compression system heat exchangers having a plurality of parallel tubes extending between a first header and a second header and, more particularly, to providing expansion of refrigerant within the inlet header for improving distribution of two-phase refrigerant flow through the parallel tubes of the heat exchanger.

BACKGROUND OF THE INVENTION

Refrigerant vapor compression systems are well known in the art. Air conditioners and heat pumps employing refrigerant vapor compression cycles are commonly used for cooling or cooling/heating air supplied to a climate controlled comfort zone within a residence, office building, hospital, school, restaurant or other facility. Refrigeration vapor compression systems are also commonly used for cooling air or other secondary fluid to provide a refrigerated environment for food items and beverage products within, for instance, display cases in supermarkets, convenience stores, groceries, cafeterias, restaurants and other food service establishments.

Conventionally, these refrigerant vapor compression systems include a compressor, a condenser, an expansion device, and an evaporator connected in refrigerant flow communication. The aforementioned basic refrigerant system components are interconnected by refrigerant lines in a closed refrigerant circuit and arranged in accord with the vapor compression cycle employed. An expansion device, commonly an expansion valve or a fixed-bore metering device, such as an orifice or a capillary tube, is disposed in the refrigerant line at a location in the refrigerant circuit upstream, with respect to refrigerant flow, of the evaporator and downstream of the condenser. The expansion device operates to expand the liquid refrigerant passing through the refrigerant line running from the condenser to the evaporator to a lower pressure and temperature. In doing so, a portion of the liquid refrigerant traversing the expansion device expands to vapor. As a result, in conventional refrigerant vapor compression systems of this type, the refrigerant flow entering the evaporator constitutes a two-phase mixture. The particular percentages of liquid refrigerant and vapor refrigerant depend upon the particular expansion device employed and the refrigerant in use, for example R12, R22, R134a, R404A, R410A, R407C, R717, R744 or other compressible fluid.

In some refrigerant vapor compression systems, the evaporator is a parallel tube heat exchanger. Such heat exchangers have a plurality of parallel refrigerant flow paths therethrough provided by a plurality of tubes extending in parallel relationship between an inlet header and an outlet header. The inlet header receives the refrigerant flow from the refrigerant circuit and distributes it amongst the plurality of flow paths through the heat exchanger. The outlet header serves to collect the refrigerant flow as it leaves the respective flow paths and to direct the collected flow back to the refrigerant line for a return to the compressor in a single pass heat exchanger or through an additional bank of heat exchange tubes in a multi-pass heat exchanger.

Historically, parallel tube heat exchangers used in such refrigerant vapor compression systems have used round tubes, typically having a diameter of ½ inch, ⅜ inch or 7 millimeters. More recently, flat, rectangular or oval shape, multi-channel tubes are being used in heat exchangers for refrigerant vapor compression systems. Each multi-channel tube has a plurality of flow channels extending longitudinally in parallel relationship the length of the tube, each channel providing a small cross-sectional flow area refrigerant path. Thus, a heat exchanger with multi-channel tubes extending in parallel relationship between the inlet and outlet headers of the heat exchanger will have a relatively large number of small cross-sectional flow area refrigerant paths extending between the two headers. In contrast, a parallel tube heat exchanger with conventional round tubes will have a relatively small number of large flow area flow paths extending between the inlet and outlet headers.

Non-uniform distribution, also referred to as misdistribution, of two-phase refrigerant flow is a common problem in parallel tube heat exchangers which adversely impacts heat exchanger efficiency. Among other factors, two-phase maldistribution problems are caused by the difference in density of the vapor phase refrigerant and the liquid phase refrigerant present in the inlet header due to the expansion of the refrigerant as it traversed the upstream expansion device.

One solution to control refrigeration flow distribution through parallel tubes in an evaporative heat exchanger is disclosed in U.S. Pat. No. 6,502,413, Repice et al. In the refrigerant vapor compression system disclosed therein, the high pressure liquid refrigerant from the condenser is partially expanded in a conventional in-line expansion device upstream of the heat exchanger inlet header to a lower pressure refrigerant. Additionally, a restriction, such as a simple narrowing in the tube or an internal orifice plate disposed within the tube, is provided in each tube connected to the inlet header downstream of the tube inlet to complete the expansion to a low pressure, liquid/vapor refrigerant mixture after entering the tube.

Another solution to control refrigeration flow distribution through parallel tubes in an evaporative heat exchanger is disclosed in Japanese Patent No. JP4080575, Kanzaki et al. In the refrigerant vapor compression system disclosed therein, the high pressure liquid refrigerant from the condenser is also partially expanded in a conventional in-line expansion device to a lower pressure refrigerant upstream of a distribution chamber of the heat exchanger. A plate having a plurality of orifices therein extends across the chamber. The lower pressure refrigerant expands as it passes through the orifices to a low pressure liquid/vapor mixture downstream of the plate and upstream of the inlets to the respective tubes opening to the chamber.

Japanese Patent No. 6241682, Massaki et al., discloses a parallel flow tube heat exchanger for a heat pump wherein the inlet end of each multi-channel tube connecting to the inlet header is crushed to form a partial throttle restriction in each tube just downstream of the tube inlet. Japanese Patent No. JP8233409, Hiroaki et al., discloses a parallel flow tube heat exchanger wherein a plurality of flat, multi-channel tubes connect between a pair of headers, each of which has an interior which decreases in flow area in the direction of refrigerant flow as a means to uniformly distribute refrigerant to the respective tubes. Japanese Patent No. JP2002022313, Yasushi, discloses a parallel tube heat exchanger wherein refrigerant is supplied to the header through an inlet tube that extends along the axis of the header to terminate short of the end the header whereby the two phase refrigerant flow does not separate as it passes from the inlet tube into an annular channel between the outer surface of the inlet tube and the inside surface of the header. The two phase refrigerant flow thence passes into each of the tubes opening to the annular channel.

Obtaining uniform refrigerant flow distribution amongst the relatively large number of small cross-sectional flow area refrigerant flow paths is even more difficult than it is in conventional round tube heat exchangers and can significantly reduce heat exchanger efficiency.

SUMMARY OF THE INVENTION

It is a general object of the invention to reduce maldistribution of refrigerant flow in a refrigerant vapor compression system heat exchanger having a plurality of multi-channel tubes extending between a first header and a second header.

It is an object of one aspect of the invention to uniformly distribute refrigerant to the individual channels of an array of multi-channel tubes.

It is an object of another aspect of the invention to delay expansion of the refrigerant in a refrigerant vapor compression system heat exchanger having a plurality of multi-channel tubes until the refrigerant flow has been distributed amongst the various tubes of an array of multi-channel tubes in a single phase as liquid refrigerant.

It is an object of a further aspect of the invention to delay expansion of the refrigerant in a refrigerant vapor compression system heat exchanger having a plurality of multi-channel tubes until the refrigerant flow has been distributed to the individual channels of an array of multi-channel tubes in a single phase as liquid refrigerant.

In one aspect of the invention, a heat exchanger is provided having a header having a hollow interior, a longitudinally extending member dividing the interior of the header into a first chamber on one side thereof and a second chamber on the other side thereof, and a plurality of heat exchange tubes each of which defines a multi-channel refrigerant flow path therethrough. Each channel defines a refrigerant flow path having an inlet at an inlet end of the heat exchange tube. The inlet end of each tube passes into the second chamber of the header and is disposed in juxtaposition with a single hole or a transversely extending row of holes of a series of longitudinally spaced openings extending through the longitudinally extending member. Fluid enters into the first chamber of the header and passes through the openings in the longitudinally extending member to be distributed to the various channels of the heat exchange tubes.

In one embodiment, each transversely extending row of holes extends transversely in juxtaposition with an inlet end of one of the plurality of heat exchange tubes with one hole per channel of the heat exchange tube. Each of the holes may have a relatively small cross-sectional area in comparison to the cross-sectional area of a channel of the heat exchange tube. Each of the holes in a row of holes may have a cross-sectional area sufficiently small as to function as an expansion orifice.

In an embodiment, the longitudinally extending member divides the interior of the header into a first chamber on one side thereof for receiving a fluid and a second chamber defining a plurality of divergent flow passages on the other side thereof. Each divergent flow path has a single inlet opening in flow communication with the first chamber and an outlet opening in flow communication to each channel of a respective heat exchange tube. The single inlet opening may have a relatively small cross-sectional area in comparison to a collective cross-sectional area of the channels of said respective heat exchange tube. The single inlet opening may have a cross-sectional area sufficiently small as to function as an expansion orifice.

In another embodiment, the plurality of multi-channel heat exchange tubes are arrayed in longitudinally spaced sets of paired heat exchange tubes. Each set of paired heat exchange tubes is arranged in juxtaposition with one set of openings of a series of longitudinally spaced openings being disposed intermediate the respective inlet ends of the paired heat exchange tubes of the set. The set of openings may comprise a row of holes extending transversely intermediate the respective inlet ends of the paired heat exchange tubes of the set. Each of the holes may have a relatively small cross-sectional area in comparison to the cross-sectional area of a channel of the heat exchange tube. Each of the holes in a row of holes may have a cross-sectional area sufficiently small as to function as an expansion orifice.

BRIEF DESCRIPTION OF THE DRAWINGS

For a further understanding of these and objects of the invention, reference will be made to the following detailed description of the invention which is to be read in connection with the accompanying drawing, where.

DETAILED DESCRIPTION OF THE INVENTION

Figure 1:
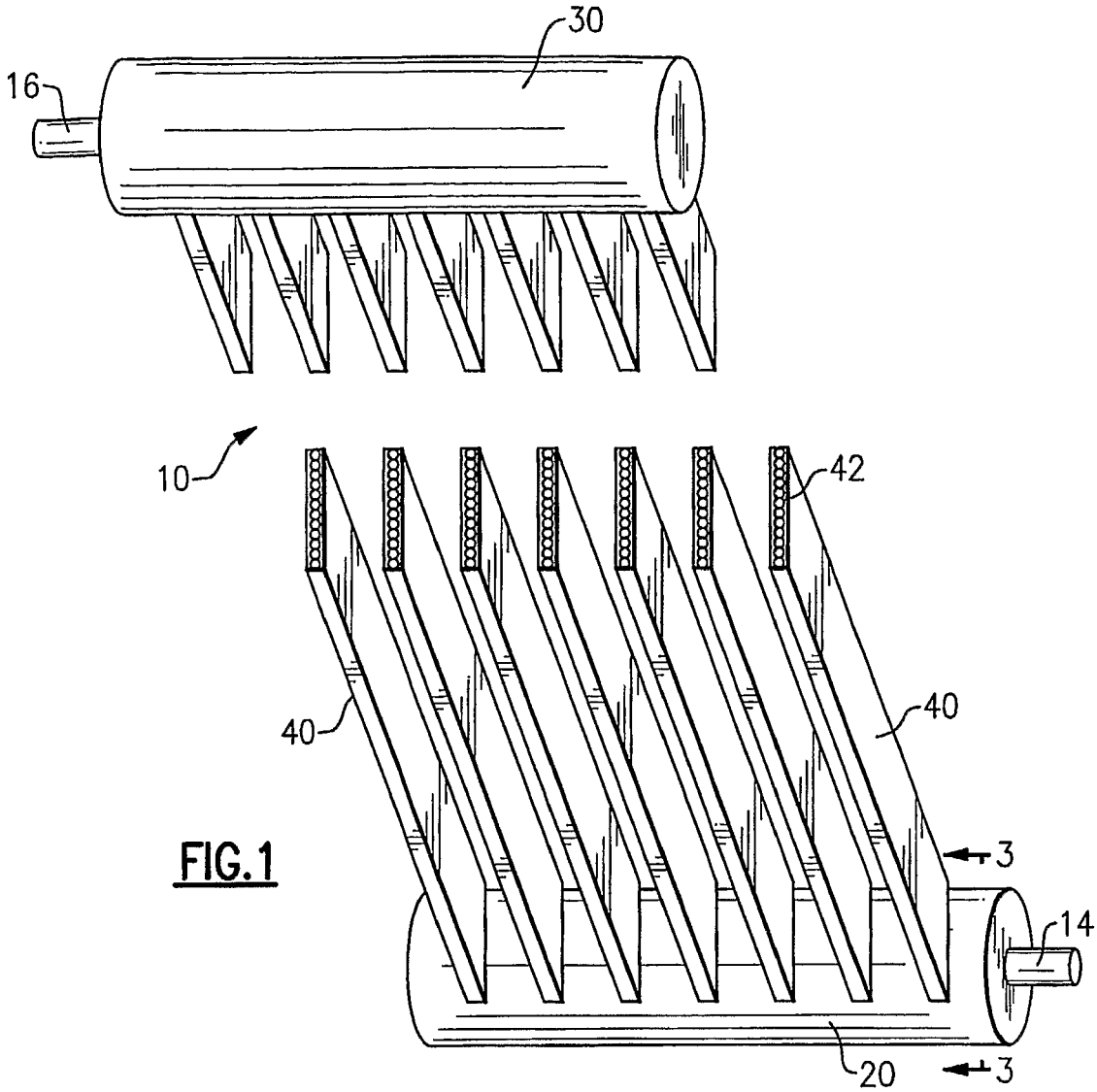
FIG. 1 is a perspective view of an embodiment of a heat exchanger in accordance with the invention.
Figure 3:
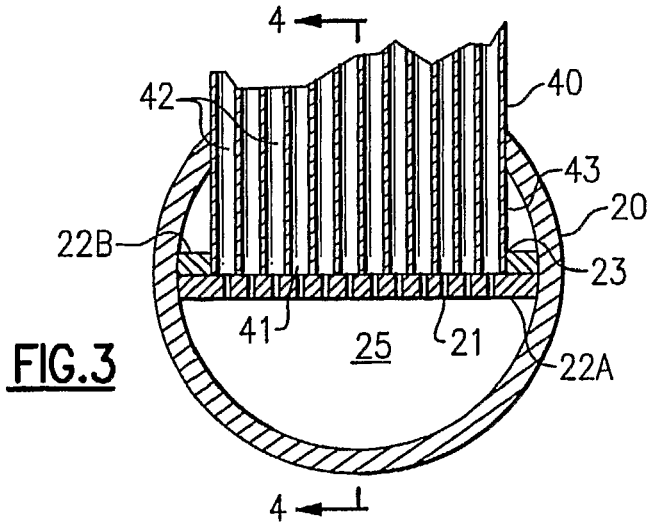
FIG. 3 is a sectioned elevation view taken along line 3-3 of FIG. 1.
Figure 2:
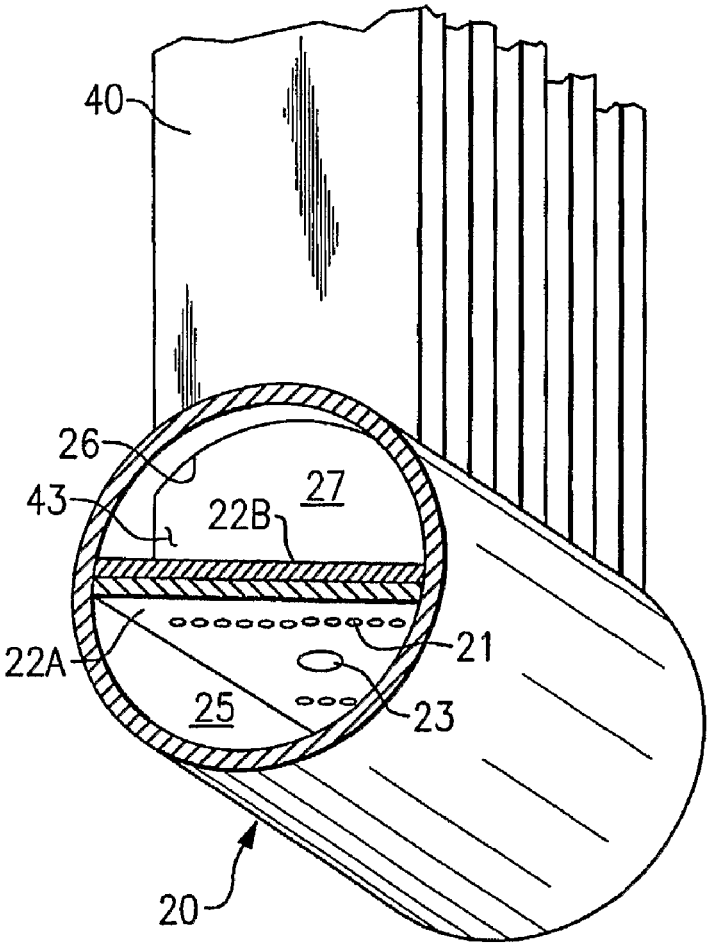
FIG. 2 is a perspective view, partially sectioned, illustrating the heat exchanger tube and inlet header arrangement of the heat exchanger of FIG. 1.

The heat exchanger 10 of the invention will be described in general herein with reference to the illustrative single pass, parallel-tube embodiment of a multi-channel tube heat exchanger as depicted in FIG. 1. The heat exchanger 10 includes an inlet header 20, an outlet header 30, and a plurality of longitudinally extending multi-channel heat exchanger tubes 40. In the illustrative embodiment of the heat exchanger 10 depicted therein, the heat exchange tubes 40 are shown arranged in parallel relationship extending generally vertically between a generally horizontally extending inlet header 20 and a generally horizontally extending outlet header 30. The inlet header 20 defines an interior volume for receiving a fluid from line 14 to be distributed amongst the heat exchange tubes 40. The outlet header 30 defines an interior volume for collecting fluid from the heat exchange tubes 40 and directing the collected fluid therefrom through line 16.

Figure 8:
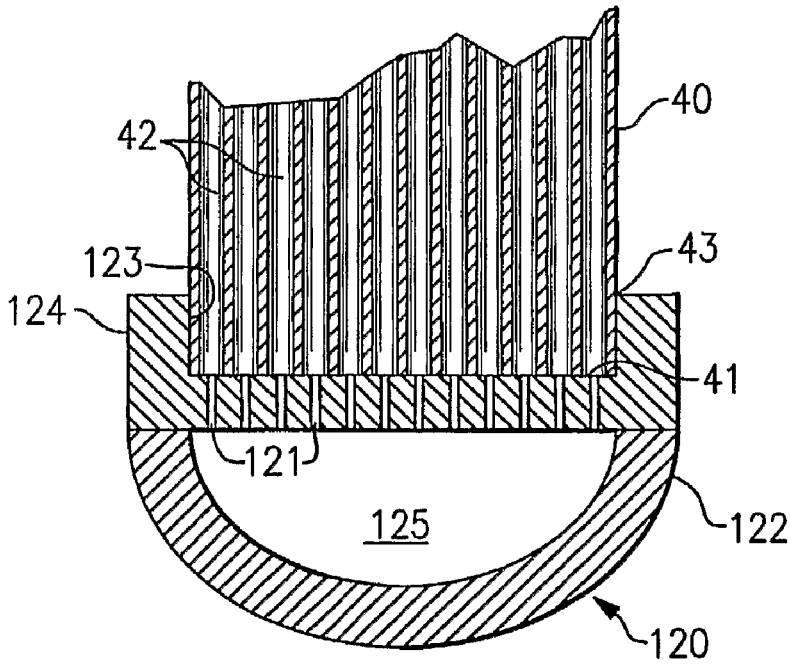
FIG. 8 is a sectioned elevation view illustrating another alternate embodiment of the heat exchanger tube and inlet header arrangement of the heat exchanger of the invention.
Figure 9:
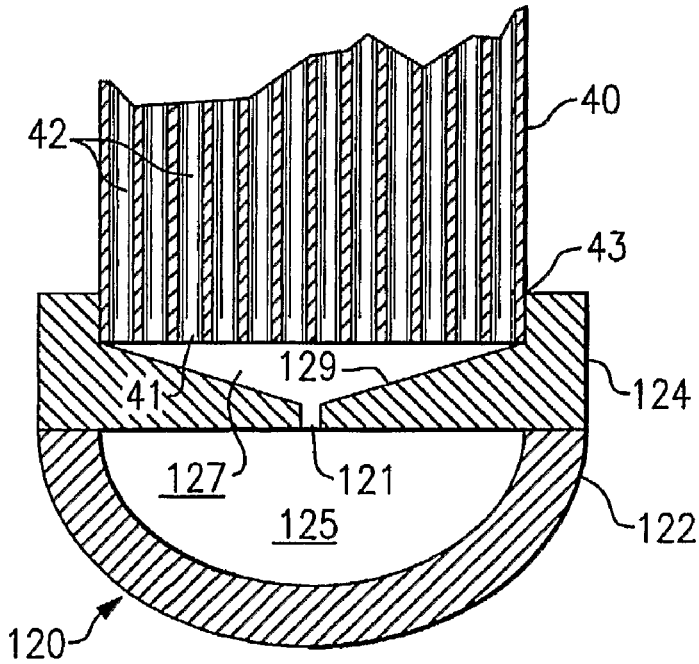
FIG. 9 is a sectioned elevation view illustrating another alternate embodiment of the heat exchanger tube and inlet header arrangement of the heat exchanger of the invention.
Figure 10:
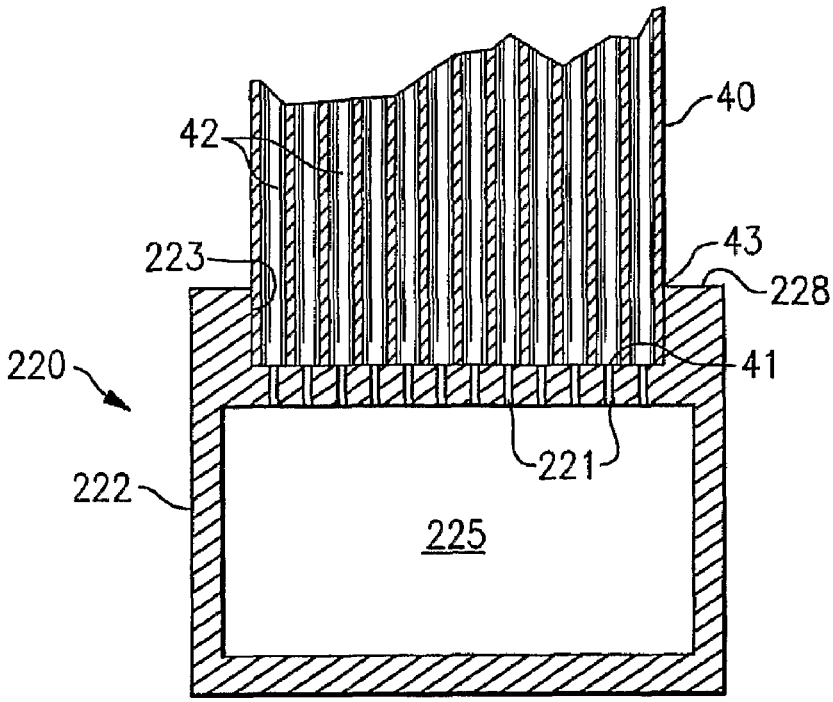
FIG. 10 is a sectioned elevation view illustrating another alternate embodiment of the heat exchanger tube and inlet header arrangement of the heat exchanger of the invention.
Figure 11:
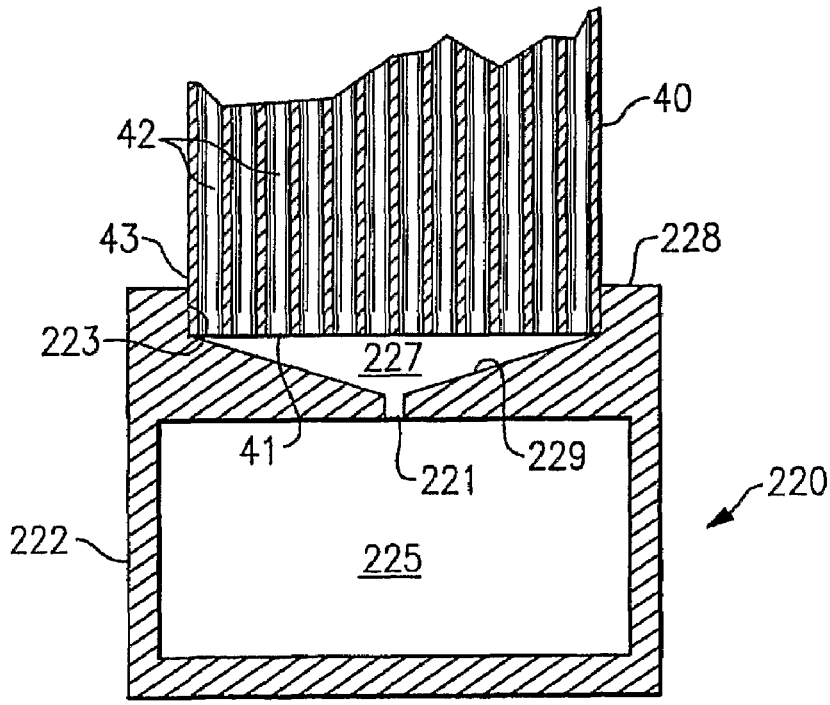
FIG. 11 is a sectioned elevation view illustrating another alternate embodiment of the heat exchanger tube and inlet header arrangement of the heat exchanger of the invention.

The plurality of longitudinally extending multi-channel heat exchanger tubes 40 thereby providing a plurality of fluid flow paths between the inlet header 20 and the outlet header 30. Each heat exchange tube 40 has an inlet end 43 in fluid flow communication with the interior volume of the inlet header 20 and an outlet end in fluid flow communication with the interior volume of the outlet header 30. In the embodiment of FIGS. 1, 2, 3 and 7, the headers 20 and 30 comprise longitudinally elongated, hollow, closed end cylinders having a circular cross-section. In the embodiment of FIGS. 8 and 9, the headers comprise longitudinally elongated, hollow, closed end cylinders having a semi-elliptical cross-section. In the embodiment of FIGS. 10 and 11, the headers comprise longitudinally elongated, hollow, closed end cylinders having a rectangular cross-section. However, the headers are not limited to the depicted configurations. For example, either header might comprise a longitudinally elongated, hollow, closed end cylinder having an elliptical cross-section or a longitudinally elongated, hollow, closed end vessel having a square, rectangular, hexagonal, octagonal, or other cross-section.

Each heat exchange tube 40 has a plurality of parallel flow channels 42 extending longitudinally, i.e. along the axis of the tube, the length of the tube thereby providing multiple, independent, parallel flow paths between the inlet of the tube and the outlet of the tube. Each multi-channel heat exchange tube 40 is a "flat" tube of, for instance, flattened rectangular or oval cross-section, defining an interior which is subdivided to form a side-by-side array of independent flow channels 42. The flat, multi-channel tubes 40 may, for example, have a width of fifty millimeters or less, typically twelve to twenty-five millimeters, and a height of about two millimeters or less, as compared to conventional prior art round tubes having a diameter of ½ inch, ⅜ inch or 7 mm. The tubes 40 are shown in drawings hereof, for ease and clarity of illustration, as having twelve channels 42 defining flow paths having a circular cross-section. However, it is to be understood that in commercial applications, such as for example refrigerant vapor compression systems, each multi-channel tube 40 will typically have about ten to twenty flow channels 42, but may have a greater or a lesser plurality of channels, as desired. Generally, each flow channel 42 will have a hydraulic diameter, defined as four times the flow area divided by the perimeter, in the range from about 200 microns to about 3 millimeters. Although depicted as having a circular cross-section in the drawings, the channels 42 may have a rectangular, triangular, trapezoidal cross-section or any other desired non-circular cross-section.

Referring now to FIGS. 2-6, in particular, a longitudinally elongated member 22 is disposed within the interior volume of the hollow, closed end inlet header 20 so as to divide the interior volume into a first chamber 25 on one side of the member 22 and a second chamber 27 on the other side of the member 22. The first chamber 25 within the inlet header 20 is in fluid flow communication with fluid inlet line 14 to receive fluid from the inlet line 14. In the embodiment depicted in FIGS. 2-6, the member 22 comprises a first longitudinally elongated plate 22A and a second longitudinally elongated plate 22B disposed into back-to-back relationship to extend the length of the header 20 with plate 22A facing the first chamber 25 and with plate 22B facing the second chamber 27. The first plate 22A is perforated by a series of rows of relatively small diameter holes 21 extending transversely across the plate at longitudinally spaced intervals along the length thereof. The second plate 22B has a series of transversely extending slots 28 provided therein at longitudinally spaced intervals along the length thereof. The rows of openings 21 and slots 28 are mutually arranged such that each row of openings 21 in plate 22A is aligned with a corresponding slot 28 in plate 22B. The member 22 may also be provided with a number of relatively larger holes 23 opening therethrough to equalize the pressure between chambers 25 and 27 disposed on opposite sides of the member 22. The pressure equalization holes 23 need not be provided if the member 22 is brazed or otherwise fixedly secured to the inside wall of the header 20.

Each heat exchange tube 40 of the heat exchanger 10 is inserted through a mating slot 26 in the wall of the inlet header 20 with the inlet end 43 of the tube extending into the second chamber 27 of the inlet header 20. Each tube 40 is inserted for sufficient length for the inlet end 43 of the tube to extend into a corresponding slot 24 in the second plate 22B. With the inlet ends 43 of the respective tubes 40 inserted into a corresponding slot 24 in the second plate 22B, the respective mouths 41 to the channels 42 of the heat exchange tube 40 are open in fluid flow communication with a corresponding row of openings 21 in the first plate 22A, thereby connecting the flow channels 42 of the tubes 40 in fluid flow communication with first chamber 25. The second plate 22B not only holds the tubes 40 in place, but also prevents refrigerant from bypassing the tubes 40.

Various alternate embodiments of the heat exchanger tube and inlet header arrangement for the heat exchanger 10 are illustrated in FIGS. 7-11. In the embodiment depicted in FIG. 7, a member 22 again divides the interior volume into a first chamber 25 on one side of the member 22 and a second chamber 37 on the other side of the member 22. In this embodiment, the longitudinally elongated member 22 comprises a first longitudinally elongated plate 22A disposed in back-to-back relationship with a second longitudinally elongated member 22B having a plurality of generally V-shape troughs 29 formed therein at longitudinally spaced intervals on the side thereof facing the tubes 40. The plate 22A faces the first chamber 25 and has a plurality of holes 21 aligned at longitudinally spaced intervals along the length of the header 20. Each one of the holes 21 opens into a respective one of the troughs 29. Each trough 29 defines a chamber 37 for receiving an inlet end 43 of a respective heat exchange tube 40 and forms a divergent flow passage extending from hole 21 at the apex of the passage to the inlet end 43 of the respective heat exchanger tube 40 received therein. Thus, the respective mouths 41 to the channels 42 of the heat exchange tube 40 are open in fluid flow communication via the divergent passage to a single opening 21.

Referring now to FIGS. 8 and 9, in the embodiments depicted therein, the header 120 is a two-piece header formed of a longitudinally elongated, closed end semi-cylindrical shell 122 and a cap member 124 brazed, or otherwise suitably secured, to the shell 122 to cover open face of the shell 122. Although illustrated as having a semi-elliptical cross-section, the shell 120 may have a semi-circular, rectilinear, hexagonal, octagonal, or other cross-section.

In the embodiment depicted in FIG. 8, the cap member 124 is a longitudinally elongated plate-like member having a plurality of longitudinally spaced, transverse extending slots 123 extending part way through the thickness of the cap member 124, each slot 123 adapted to receive the inlet end 43 of one of the multi-channel tubes 40. Additionally, the cap member 124 is perforated by a series of rows of relatively small diameter holes 121 extending transversely across the plate at longitudinally spaced intervals along the length thereof. As in the FIG. 3 embodiment discussed previously, the rows of openings 121 and slots 123 are mutually arranged such that each row of openings 121 in the member 124 is aligned with a corresponding slot 123 in member 124. With the inlet ends 43 of the respective tubes 40 inserted into a corresponding slot 123 in the member 124, the respective mouths 41 to the channels 42 of the heat exchange tube 40 are open in fluid flow communication with a corresponding row of openings 121 in the member 124, thereby connecting the flow channels 42 of the tubes 40 in fluid flow communication with interior chamber 125 of the header 120.

In the embodiment depicted in FIG. 9, the cap member 124 comprises a longitudinally elongated member having a plurality of generally V-shape troughs 129 formed therein at longitudinally spaced intervals on the side thereof facing the tubes 40. Each trough 129 defines a chamber 127 for receiving an inlet end 43 of a respective heat exchange tube 40 and forms a divergent flow passage extending from a hole 121 at the apex of the passage to the inlet end 43 of the respective heat exchanger tube 40 received therein. Each hole 121 opens in fluid flow communication with the fluid chamber 125. Thus, as in the FIG. 7 embodiment discussed previously, the respective mouths 41 to the channels 42 of each heat exchange tube 40 are open in fluid flow communication via a divergent passage to a single opening 21.

Referring now to FIGS. 10 and 11, the header 220 is a one-piece header formed of a longitudinally elongated, hollow, closed end, shell 222. Although illustrated as having a rectilinear cross-section, the shell 222 may have an ovate, hexagonal, octagonal, or other cross-section. Wall 228 of the shell 222 has a plurality of longitudinally spaced, transverse extending slots 223 extending part way through the thickness of the wall, with each slot 223 adapted to receive the inlet end 43 of one of the multi-channel tubes 40.

In the embodiment depicted in FIG. 10, the wall 228 is perforated by a series of rows of relatively small diameter holes 221 extending transversely across the plate at longitudinally spaced intervals along the length thereof. The rows of openings 221 and slots 223 are mutually arranged such that each row of openings 221 is aligned with a corresponding slot 223 in the wall 228. Therefore, as in the FIG. 3 and FIG. 8 embodiments, with the inlet ends 43 of the respective tubes 40 inserted into a corresponding slot 223, the respective mouths 41 to the channels 42 of the heat exchange tube 40 are open in fluid flow communication with a corresponding row of openings 221, thereby connecting the flow channels 42 of the tubes 40 in fluid flow communication with interior chamber 225 of the header 220.

In the embodiment depicted in FIG. 11, commensurate with each slot 223, the wall 228 has a generally V-shape trough 229. Each trough 129 defines a chamber 227 for receiving an inlet end 43 of a respective heat exchange tube 40 and forms a divergent flow passage extending from a hole 221 at the apex of the passage to the inlet end 43 of the respective heat exchanger tube 40 received therein. Each hole 221 opens in fluid flow communication with the fluid chamber 225. Thus, as in the FIG. 7 and FIG. 9 embodiments discussed previously, the respective mouths 41 to the channels 42 of each heat exchange tube 40 are open in fluid flow communication via a divergent passage to a single opening 221.

Figure 12:
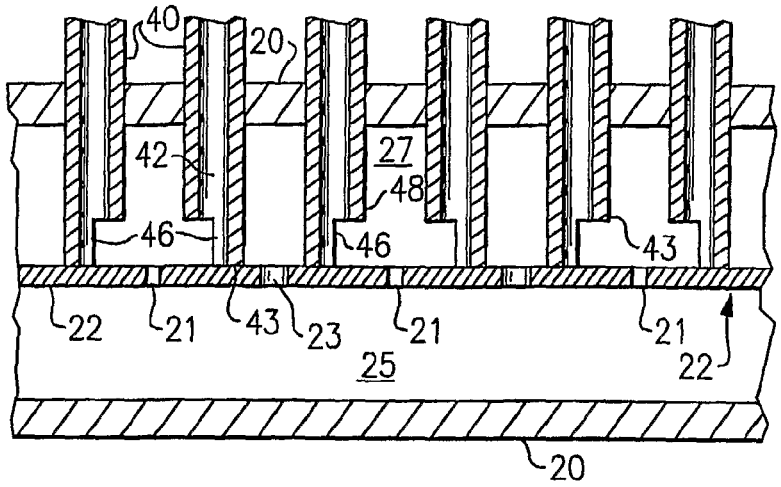
FIG. 12 is a sectioned elevation view taken along a longitudinal line illustrating a further embodiment of the heat exchanger tube and inlet header arrangement of the heat exchanger of FIG. 1.
Figure 13:
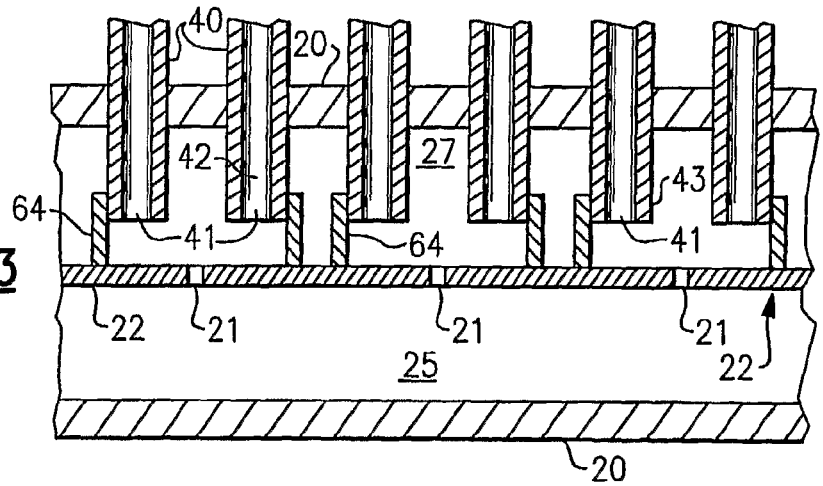
FIG. 13 is a sectioned elevation view taken along a longitudinal line illustrating another embodiment of the heat exchanger tube and inlet header arrangement of the heat exchanger of FIG. 1.

Additional alternate embodiments of the heat exchanger tube and inlet header arrangement for the heat exchanger 10 are illustrated in FIGS. 12 and 13. In each embodiment, the longitudinally elongated plate 22, which is disposed within the interior volume of the hollow, closed end inlet header 20 so as to divide the interior volume into a first chamber 25 on one side of the plate 22 and a second chamber 27 on the other side of the plate 22, is perforated by a series of rows of a plurality of holes 21 extending at longitudinally spaced intervals along the length thereof. Each heat exchange tube 40 of the heat exchanger 10 is inserted through a mating slot in the wall of the inlet header 20 with the inlet end 43 of the tube extending into the second chamber 27 of the inlet header 20. In these embodiments, the rows of holes 21 are arranged such that one row of holes 21 is located between each set of paired tubes 40, rather than a row of holes per tube as in the FIG. 1 embodiment.

In the embodiment depicted in FIG. 12, the inlet end 43 of each tube 40 is inserted into the chamber 27 until the face of the inlet end 43 contacts the plate 22. A transversely extending opening 46 is cut in the side 48 of the inlet end of each set of paired tubes 40 that faces the row of holes 21. The opening 46 provides an inlet in the side 48 to each channel 42 of a tube 40. Fluid flows from the chamber 25 of the header 20 through each of the holes 21 and thence through the openings 46 in the sides 48 of the paired set of tubes 40 associated therewith.

In the embodiment depicted in FIG. 13, the inlet end 43 of each tube 40 is inserted into the chamber 25 of the header 20, but not far enough to contact the plate 22. Rather, the inlet end 43 of each tube 40 is positioned such the face of the inlet end 43 is juxtaposed in spaced relationship to the plate 22 to provide a gap 61 between the end face of the inlet end 43 and the plate 22. Fluid flows form the chamber 25 of the header 20 through each row of holes 21 and thence through the gap 61 and into the mouths 41 of the channels 42 of the tubes 40 of the paired set of tubes associated with each respective row of holes 21. To prevent the fluid from flowing elsewhere within the chamber 27, rather than proceeding directly into the mouths 41 of the channels 42 of the tubes 40, a pair of transversely extending baffles 64 is provided about each paired set of tubes 40.

In the embodiments depicted in FIGS. 3, 8, 10, 12 and 13, each of the individual openings 21 in the member 22 has a relatively small cross-sectional flow area in comparison to the cross-sectional area of an individual flow channel 42. The relatively small cross-sectional area provides uniformity in pressure drop in the fluid flowing from the first chamber 25 within the header 20 through the openings 21 into the flow channels 42 of the various multi-channel tubes 40, thereby ensuring a relatively uniform distribution of fluid amongst the individual tubes 40 opening into the inlet header 20. Additionally, each of the openings 21 may have a flow area small enough in relation to the flow area of the individual flow channels 42 of the multi-channel tubes 40 to ensure that a desired level of expansion of the high pressure liquid fluid to a low pressure liquid and vapor mixture will occur as the fluid flows through each opening 21 to enter a corresponding mouth 41 of a channel 42. For example, the flow area of an opening 21 may be on the order of a tenth of a millimeter (0.1 millimeters) for a heat exchange tube 40 having channels with a nominal 1 square millimeter internal flow area to ensure expansion of the fluid passing therethrough. Of course, as those skilled in the art will recognize, the degree of expansion can be adjusted by selectively sizing the flow area of a particular opening 21 relative to the flow area of the flow channel 42 that will receive fluid passing through that particular opening 21.

Figure 7:
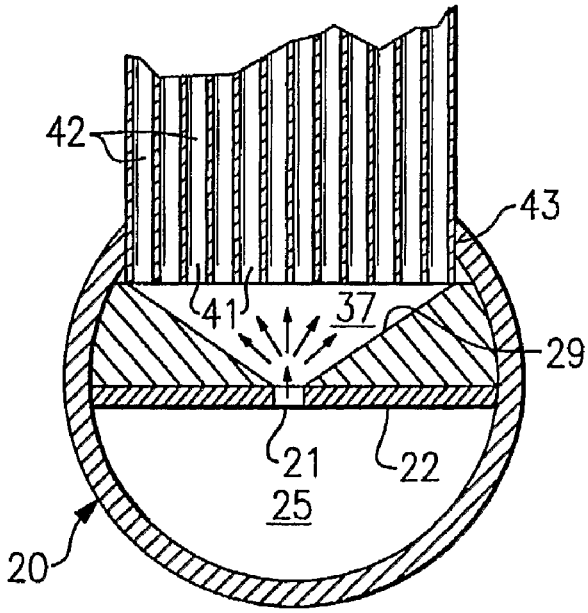
FIG. 7 is a sectioned elevation view illustrating an alternate embodiment of the heat exchanger tube and inlet header arrangement of the heat exchanger of the invention.
Figure 4:
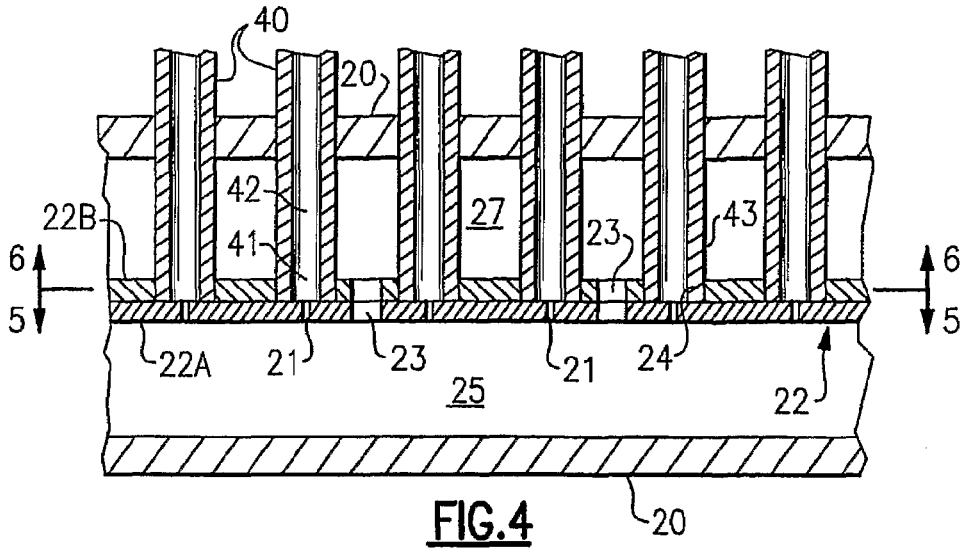
FIG. 4 is sectioned elevation view taken along line 4-4 of FIG. 3, further illustrating the heat exchanger tube and inlet header arrangement of the heat exchanger of FIG. 1.
Figure 5:
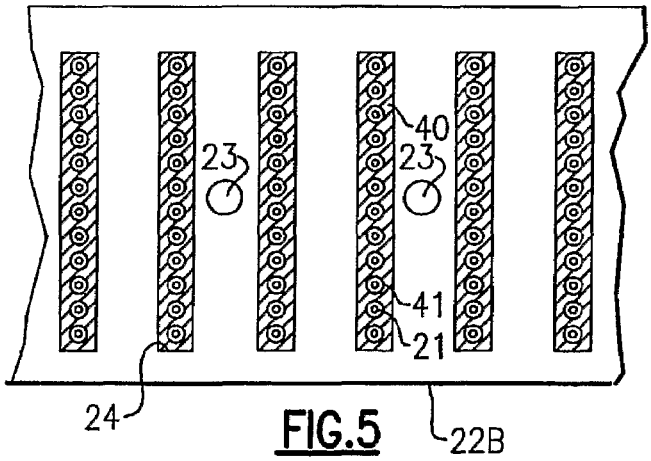
FIG. 5 is a sectioned plan view taken along line 5-5 of FIG. 4.
Figure 6:
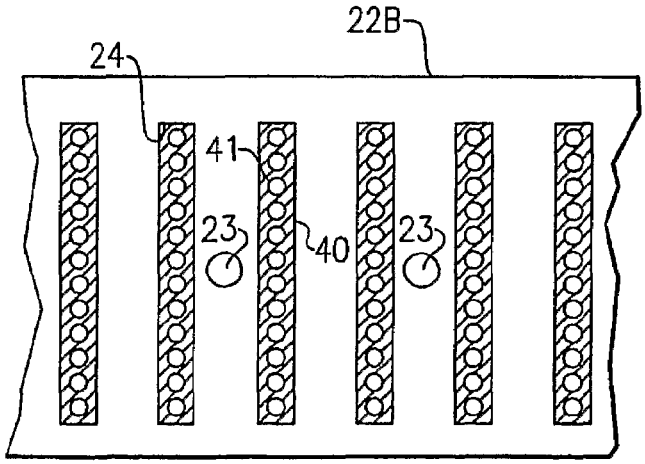
FIG. 6 is a sectioned plan view taken along line 6-6 of FIG. 4.

In the embodiments depicted in FIGS. 7, 9 and 11, wherein a single hole 21 opens in flow communication through a divergent flow passage to a plurality of flow channels 42, each of the single openings 21 again has a relatively small cross-sectional flow area, in relation to the collective flow area of the individual flow channels 42 of the multi-channel tube 40 associated therewith, to provide uniformity in pressure drop in the fluid flowing from the fluid chamber within the header 20 through the openings 21 into the flow channels 42 of the various multi-channel tubes 42, thereby ensuring a relatively uniform distribution of fluid amongst the individual tubes 40 opening into the inlet header 20. Additionally, each of the single openings 21 may have a flow area small enough in relation to the collective flow area of the individual flow channels 42 of the multi-channel tube 40 associated therewith to ensure that a desired level of expansion of the high pressure liquid fluid to a low pressure liquid and vapor mixture will occur as the fluid flows through each opening 21 into the divergent flow passage downstream thereof. Of course, as those skilled in the art will recognize, the degree of expansion can be adjusted by selectively sizing the flow area of a particular opening 21.

Figure 14:
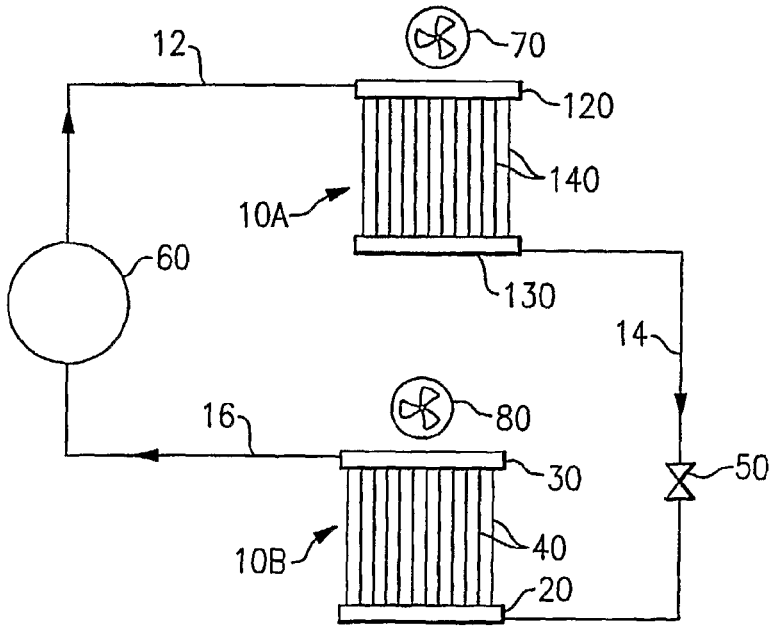
FIG. 14 is a schematic illustration of a refrigerant vapor compression system incorporating the heat exchanger of the invention.

Referring now to FIG. 14, there is depicted schematically a refrigerant vapor compression system 100 having a compressor 60, the heat exchanger 10A, functioning as a condenser, and the heat exchanger 10B, functioning as an evaporator, connected in a closed loop refrigerant circuit by refrigerant lines 12, 14 and 16. As in conventional refrigerant vapor compression systems, the compressor 60 circulates hot, high pressure refrigerant vapor through refrigerant line 12 into the inlet header 120 of the condenser 10A, and thence through the heat exchanger tubes 140 of the condenser 10A wherein the hot refrigerant vapor condenses to a liquid as it passes in heat exchange relationship with a cooling fluid, such as ambient air which is passed over the condenser heat exchange tubes 140 by the condenser fan 70. The high pressure, liquid refrigerant collects in the outlet header 130 of the condenser 10A and thence passes through refrigerant line 14 to the inlet header 20 of the evaporator 10B. The refrigerant thence passes through the heat exchanger tubes 40 of the evaporator 10B wherein the refrigerant is heated as it passes in heat exchange relationship with air to be cooled which is passed over the heat exchange tubes 40 by the evaporator fan 80. The refrigerant vapor collects in the outlet header 30 of the evaporator 10B and passes therefrom through refrigerant line 16 to return to the compressor 60 through the suction inlet thereto.

In the embodiment depicted in FIG. 14, the condensed refrigerant liquid passes through an expansion valve 50 operatively associated with the refrigerant line 14 as it passes from the condenser 10A to the evaporator 10B. In the expansion valve 50, the high pressure, liquid refrigerant is partially expanded to lower pressure, liquid refrigerant or a liquid/vapor refrigerant mixture. In this embodiment, the expansion of the refrigerant is completed within the evaporator 10B as the refrigerant passes through the relatively small flow area opening or openings 21, 121, 221 upstream of entering the flow channels of the heat exchange tubes 40. Partial expansion of the refrigerant in an expansion valve upstream of the inlet header 20 to the evaporator 10B may be advantageous when the flow area of the openings 21, 121, 221 can not be made small enough to ensure complete expansion as the liquid passes therethrough or when an expansion valve is used as a flow control device. In an alternate embodiment of the refrigerant vapor compression system, the expansion valve 50 may be eliminated with expansion of the refrigerant passing from the condenser 10A occurring entirely within the heat exchanger 10B.

Although the exemplary refrigerant vapor compression cycle illustrated in FIG. 14 is a simplified air conditioning cycle, it is to be understood that the heat exchanger of the invention may be employed in refrigerant vapor compression systems of various designs, including, without limitation, heat pump cycles, economized cycles and commercial refrigeration cycles. Additionally, those skilled in the art will recognize that the heat exchanger of the present invention may be used as a condenser and/or as an evaporator in such refrigerant vapor compression systems.

Further, the depicted embodiment of the heat exchanger 10 is illustrative and not limiting of the invention. It is to be understood that the invention described herein may be practiced on various other configurations of the heat exchanger 10. For example, the heat exchange tubes may be arranged in parallel relationship extending generally horizontally between a generally vertically extending inlet header and a generally vertically extending outlet header. Further, those skilled in the art will recognize that the heat exchanger of the invention is not limited to the illustrated single pass embodiments, but may also be arranged in various single pass embodiments and multi-pass embodiments.

Accordingly, while the present invention has been particularly shown and described with reference to the embodiments as illustrated in the drawing, it will be understood by one skilled in the art that various changes and modifications, some of which have been mentioned hereinbefore, may be effected without departing from the spirit and scope of the invention as defined by the claims.

We claim:

1. A heat exchanger comprising:

a header having a hollow interior;

a longitudinally extending member dividing the interior of said header into a first chamber on one side thereof for receiving a fluid and a second chamber on the other side thereof, said member having a series of longitudinally spaced openings extending therethrough; and a plurality of heat exchange tubes, each of said plurality of heat exchange tubes defining a multi-channel refrigerant flow path therethrough, each channel of said multi-channel refrigerant flow path having an inlet at an inlet end of said heat exchange tube, the respective inlet end of each of said plurality of heat exchange tubes passing into said second chamber of said header and disposed in juxtaposition with a respective one of said openings of said series of longitudinally spaced openings wherein each of said openings comprises a row of holes extending transversely in juxtaposition with one of said plurality of heat exchange tubes with one hole per channel of said heat exchange tube.

2. A heat exchanger as recited in claim 1 wherein each of said holes has a relatively small cross-section relative to a cross-section of a channel of said heat exchange tube.

3. A heat exchanger as recited in claim 2 wherein each of said holes comprises an expansion orifice.

4. A heat exchanger as recited in claim 1 wherein said longitudinally extending member divides the interior of said header into a first chamber on one side thereof for receiving a fluid and a second chamber defining a plurality of divergent flow passages on the other side thereof, each divergent flow path having a single inlet opening in flow communication with said first chamber and an outlet opening with flow communication to each channel of a respective heat exchange tube.

5. A heat exchanger as recited in claim 4 wherein said single hole has a relatively small cross-sectional area in comparison to a collective cross-sectional of the channels of said respective heat exchange tube.

6. A heat exchanger as recited in claim 5 wherein said single hole comprises an expansion orifice.

7. A heat exchanger comprising:

a header having a hollow interior;

a longitudinally extending member dividing the interior of said header into a first chamber on one side thereof for receiving a fluid and a second chamber on the other side thereof, said member having a series of longitudinally spaced openings extending therethrough; and a plurality of sets of paired heat exchange tubes, each of said heat exchange tubes defining a multi-channel refrigerant flow path therethrough, each channel of said multi-channel refrigerant flow path having an inlet at an inlet end of said heat exchange tube, the respective inlet ends of each heat exchange tube passing into said second chamber of said header, each set of said plurality of sets of paired heat exchange tubes being arranged with one of said openings of said series of longitudinally spaced openings being disposed intermediate the respective inlet ends of the paired heat exchange tubes of said set wherein each of said openings comprises a row of holes extending transversely in juxtaposition with one of said plurality of heat exchange tubes with one hole per channel of said heat exchange tube.

8. A heat exchanger as recited in claim 1 wherein each of said holes has a relatively small cross-section relative to a cross-section of a channel of said heat exchange tube.

9. A heat exchanger as recited in claim 2 wherein each of said holes comprises an expansion orifice.

* * * * *